US005794379A

United States Patent [19]

McKay

[11] Patent Number: 5,794,379

[45] Date of Patent: Aug. 18, 1998

[54] WOODEN VASE FOR HOLDING CUT FLOWERS

[76] Inventor: Jerry H. McKay, 30609 Inkster Rd., Franklin, Mich. 48025

[21] Appl. No.: 735,017

[22] Filed: Oct. 22, 1996

Related U.S. Application Data

[60] Provisional application No. 60/005,849 Oct. 23, 1995.

[51] Int. Cl.[6] ..... A01G 5/00; A47G 7/00

[52] U.S. Cl. ..... 47/41.01; D11/146

[58] Field of Search ..... 47/41.01, 65.5; D11/143, 146

[56] References Cited

U.S. PATENT DOCUMENTS

| | | | |
|---|---|---|---|
| D. 23,465 | 7/1894 | Slater | D11/151 |
| D. 120,872 | 6/1940 | Prouty | 47/41.01 |
| D. 289,148 | 4/1987 | Laslo | D11/146 |

FOREIGN PATENT DOCUMENTS

| | | | |
|---|---|---|---|
| 3346275 | 7/1985 | Germany | 47/41.01 |
| 291181 | 5/1928 | United Kingdom | 47/41.01 |

*Primary Examiner*—Michael J. Carone
*Assistant Examiner*—Joanne C. Downs
*Attorney, Agent, or Firm*—John R. Benefiel

[57] ABSTRACT

A turned burlwood vase has an epoxy coating on the interior to allow the vase to hold water for preserving fresh flowers.

3 Claims, 1 Drawing Sheet

WOODEN VASE FOR HOLDING CUT FLOWERS

CROSS-REFERENCE TO RELATED APPLICATION

This application is based on provisional application U.S. Ser. No. 60/005,849, filed Oct. 23, 1995.

BACKGROUND OF THE INVENTION

This invention concerns vases for holding live cut flowers. Such vases are typically constructed of glass or ceramic material so as to be able to hold water for maintaining the freshness of cut flowers for long periods.

Wooden vessels have in the past received special treatment when used to hold water, such as by applying tar or pitch to seal barrels or tanks constructed of wooden staves. It has also heretofore been known to construct separate plastic liners to fit into a wooden vessel.

Flower vases are preferably of a graceful design, rather than a simple cylindrical shape. Vases of turned burlwood having a tapering shape with a narrower top than bottom are particularly attractive. Such vases feature an irregular top edge formed by the natural burlwood contour. Being wood, it has not been practical to allow water to be held in these vases. Heretofore, glass test tubes have been inserted in straight drilled openings in the vase. However, the test tubes are fragile, are available only in standard sizes, and are of limited volume.

Also, a straight-sided hole for the test tube creates thick vase walls, slowing the drying of the wood.

Plastic liners cannot be fit to tapering shapes or to irregular top edges. Also, separate liners are costly where many different shapes must be accommodated, as is the case for the great variety of shapes of natural wood pieces made into vases.

It is the object of the present invention to provide a natural wood vase able to hold water to be usable as a fresh flower vase without requiring a separate liner piece.

SUMMARY OF THE INVENTION

The above-recited object of the present invention is achieved by applying a thick coating of an epoxy resin to the interior surface of a turned wooden vase, forming a water holding vessel and enabling use of the vase to hold fresh cut flowers.

The vase is preferably a turning made from burlwood having a tapering shape and an irregular top lip edge. The coating closes any small holes in the vase wall as well as protecting the wood from direct contact with the water in the vase.

A preferred epoxy resin is diglycidyl ether of bisphenol A, sold under the designation of General Purpose Epoxy Resin TCC-205 by TCC of Ferndale, Mich., and a hardener of a modified aliphatic amine, sold as Epoxy Hardener TCC-102 by TCC of Ferndale, Mich.

DETAILED DESCRIPTION

Figure 1:
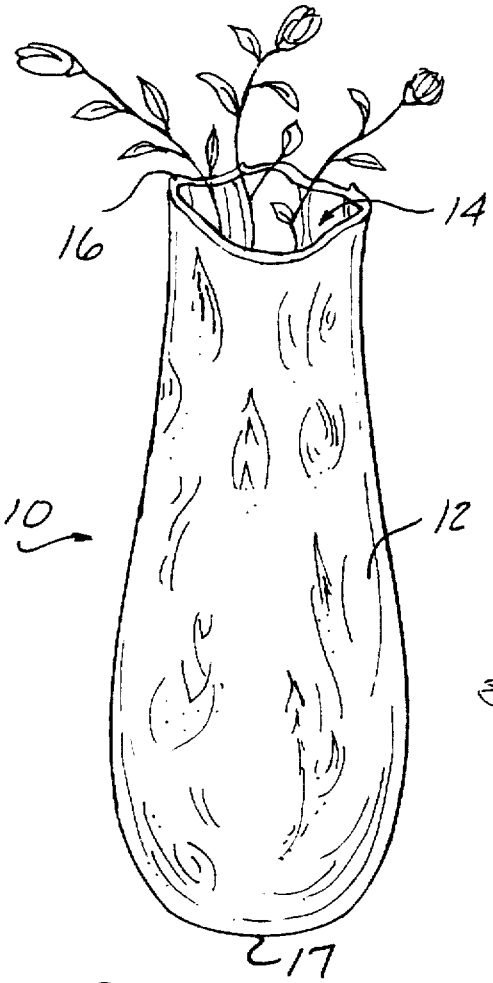
FIG. 1 is a perspective view of a turned burlwood flower vase according to the present invention.
Figure 2:
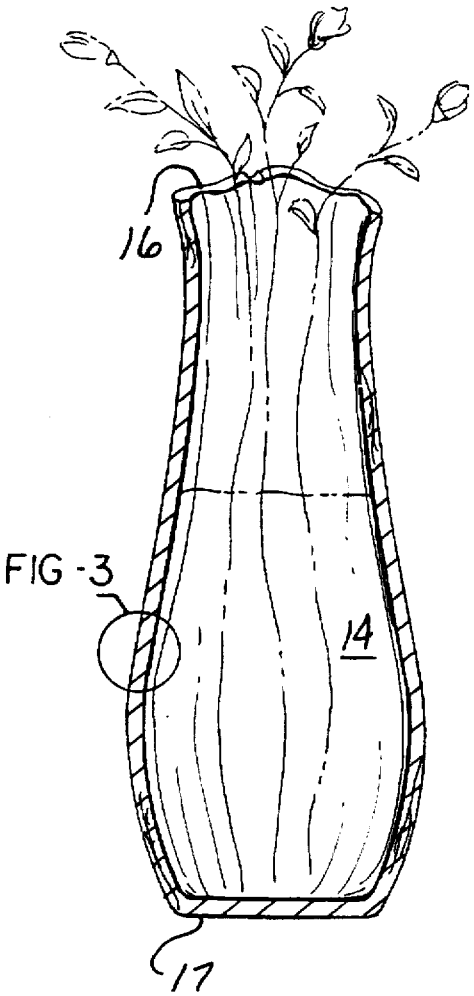
FIG. 2 is a lengthwise sectional view of the vase shown in FIG. 1.
Figure 3:
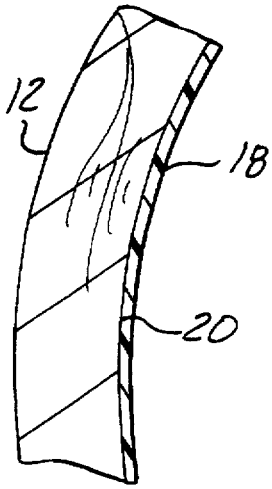
FIG. 3 is a fragmentary enlarged view of a wall section of the encircled area of the vase shown in FIG. 2.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, a wooden vase 10 is shown. The vase 10 is constructed from a piece of burlwood from a hardwood species such as maple or walnut, which is turned on a wood lathe to have a smoothly curving exterior surface 12 producing a richly patterned appearance from the characteristic graining of a burlwood pieces An interior cavity 14 is machined into the burlwood piece for receiving cut flowers, preferably to form a substantially constant wall thickness of maximum water capacity. An irregular lip 16 characterizes the open top of vases made in this way. A flat bottom 17 allows the vase 10 to rest securely on a table, shelf, etc.

According to the concept of the present invention, a thick coating 18 is applied to the entire surface 20 of the cavity 14 comprised of a cured epoxy resin.

The preferred resin is diglycidyl ether of bisphenol A, sold under the designation of General Purpose Epoxy Resin TCC-205 by TCC of Ferndale, Mich., and a hardener of a modified aliphatic amine, sold as Epoxy Hardener TCC-102 by TCC of Ferndale, Mich.

This coating may be brush applied. The result is to define a water-resistant vessel within cavity 14 which is defined by the turned shape of the cavity itself.

Vases so constructed have been found to allow water to be poured into the cavity 14 for keeping cut flowers fresh, without affecting the wood of the vase body, i.e., without causing rotting, swelling, splitting, etc., which otherwise would be expected to occur.

The irregularities encountered with the natural burlwood pieces and a great variety of individual turning shapes are accommodated and the use of a separate liner piece avoided.

I claim:

1. A flower vase comprising:

a turned burlwood vessel having a flat bottom adapted to rest on a surface and having a cavity machined thereinto defined by an irregular top edge; a wall of substantially constant thickness, said wall having an inner surface and, an epoxy coating applied to the entire inner surface defining said cavity to perform as a water vessel for holding water to keep cut flowers fresh.

2. The flower vase according to claim 1 wherein said epoxy coating is a resin comprising diglycidyl ether of bisphenol A.

3. The flower vase according to claim 1 wherein said epoxy coating is cured with a hardener comprising a modified aliphatic amine.

* * * * *